US008419397B2

(12) United States Patent
Gotou et al.

(10) Patent No.: US 8,419,397 B2
(45) Date of Patent: Apr. 16, 2013

(54) SCREW COMPRESSOR

(75) Inventors: Hideyuki Gotou, Sakai (JP); Nozomi Gotou, Sakai (JP); Harunori Miyamura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 657 days.

(21) Appl. No.: 12/601,117

(22) PCT Filed: May 7, 2008

(86) PCT No.: PCT/JP2008/058490

§ 371 (c)(1),
(2), (4) Date: Nov. 20, 2009

(87) PCT Pub. No.: WO2008/142994

PCT Pub. Date: Nov. 27, 2008

(65) Prior Publication Data

US 2010/0158737 A1 Jun. 24, 2010

(30) Foreign Application Priority Data

May 23, 2007 (JP) ..... 2007-136079
Apr. 22, 2008 (JP) ..... 2008-111337

(51) Int. Cl.
*F03C 4/00* (2006.01)
*F04C 2/00* (2006.01)
*F04C 18/00* (2006.01)

(52) U.S. Cl.
USPC ..... 418/195; 418/140; 418/144

(58) Field of Classification Search ..... 418/104, 418/140, 144, 195–197
See application file for complete search history.

(56) References Cited

U.S. PATENT DOCUMENTS

| | | | | | |
|---|---|---|---|---|---|
| 3,133,695 | A | | 5/1964 | Zimmern | |
| 3,180,565 | A | | 4/1965 | Zimmern | |
| 4,475,877 | A | * | 10/1984 | Zimmern | 418/140 |
| 4,484,872 | A | * | 11/1984 | Ohtsuki | 418/140 |
| 5,051,077 | A | * | 9/1991 | Yanagisawa et al. | 418/197 |
| 5,087,182 | A | * | 2/1992 | Zimmern et al. | 418/195 |

FOREIGN PATENT DOCUMENTS

| | | |
|---|---|---|
| FR | 1331998 | 12/1963 |
| JP | 47-002979 | 2/1972 |
| JP | 01-144489 U | 10/1989 |
| JP | 06-042474 A | 2/1994 |
| JP | 3731399 B2 | 10/2005 |

* cited by examiner

*Primary Examiner* — Theresa Trieu
(74) *Attorney, Agent, or Firm* — Global IP Counselors

(57) ABSTRACT

A screw compressor includes a casing, a screw rotor and a gate rotor. The casing has a cylinder. The screw rotor is cylindrical-shaped and configured to be fitted into the cylinder. The gate rotor is configured to be engaged with the screw rotor. A, outlet width of a seal surface of the casing on a gas-outlet side of the screw rotor is larger than an inlet width of the seal surface on a gas-inlet side of the screw rotor. The seal surface of the casing is opposed to one surface of the gate rotor.

9 Claims, 9 Drawing Sheets

SCREW COMPRESSOR

CROSS-REFERENCE TO RELATED APPLICATIONS

This U.S. National stage application claims priority under 35 U.S.C. §119(a) to Japanese Patent Application No. 2007-136079, filed in Japan on May 23, 2007, and 2008-111337, filed in Japan on Apr. 22, 2008, the entire contents of which are hereby incorporated herein by reference.

TECHNICAL FIELD

The present invention relates to a screw compressor for gas compression, for example, compression of a refrigerant gas.

BACKGROUND ART

Conventionally, there has been a screw compressor in which, as shown in an enlarged sectional view of FIG. 8, a screw rotor 102 is housed in a cylinder 110 of a casing 101 and a gate rotor 103 is engaged with the screw rotor 102 so that gas compression is fulfilled by a compression chamber defined by mutual engagement of the screw rotor 102 and the gate rotor 103 (see JP 3731399 B2).

That is, as shown in FIG. 9, which is taken along the line B-B of FIG. 8, groove portions 121 of the screw rotor 102 and tooth portions 131 of the gate rotor 103 are engaged with each other, respectively, to form the compression chamber. Then, a low-pressure gas is sucked into the compression chamber from one end side of the screw rotor 102 in its axis 102*a* direction. After the low-pressure gas is compressed in the compression chamber, the compressed high-pressure gas is discharged from the other end side of the screw rotor 102 in its axis 102*a* direction.

In FIG. 9, the left side of the screw rotor 102 as viewed in the drawing sheet is assumed as an inlet side on which the gas is sucked into the compression chamber, while the right side of the screw rotor 102 in the drawing sheet is assumed as an outlet side on which the gas is discharged from the compression chamber.

As shown in FIGS. 8 and 9, between one surface 130 of the gate rotor 103 and a seal surface 111 of the casing 101 opposed to the one surface 130 is a slight gap, by which contact of the seal surface 111 of the casing 101 and the one surface 130 of the gate rotor 103 with each other is prevented. A width W of the seal surface 111 is uniform over a range from inlet side to outlet side of the screw rotor 102.

SUMMARY OF INVENTION

Technical Problem

However, in the conventional screw compressor described above, since the width W of the seal surface 111 is uniform over the range from inlet side to outlet side of the screw rotor 102 as shown in FIG. 9, there has been a problem that on the outlet side of the screw rotor 102, the gas within the compression chamber may leak out through between the seal surface 111 of the casing 101 and the one surface 130 of the gate rotor 103 in an arrow L direction so as to be directed into a low-pressure space in which the gate rotor 103 is housed (hereinafter, a pressure of this space will be referenced by Pg).

More specifically, the gas pressure in the compression chamber is higher on the outlet side of the screw rotor 102 ($Ps<Pd$ in FIG. 9), while the width W of the seal surface 111 is constant. Therefore, on the outlet side of the screw rotor 102, a pressure gradient ($dP/dx=(Pd-Pg)/W$) between the seal surface 111 and the one surface 130 becomes greater so that the gas within the compression chamber leaks out on the outlet side of the screw rotor 102.

On the other hand, if the width W of the seal surface 111 is uniformly increased with a view to preventing gas leaks through between the casing 101 and the gate rotor 103, the area over which the seal surface 111 should have a flatness is increased, resulting in a problem of contact of the casing 101 and the gate rotor 103 with each other.

Accordingly, an object of the present invention is to provide a screw compressor capable of preventing contact of the casing and the gate rotor with each other while preventing gas leaks through between the casing and the gate rotor.

Solution to Problem

In order to achieve the above object, there is provided a screw compressor in accordance with one aspect of the present invention, which comprises a casing having a cylinder;

a cylindrical-shaped screw rotor to be fitted to the cylinder; and a gate rotor to be engaged with the screw rotor, wherein with regard to a width of a seal surface of the casing opposed to one surface of the gate rotor, a width on a gas-outlet side of the screw rotor is larger than a width on a gas-inlet side of the screw rotor.

With such a screw compressor, with regard to the width of the seal surface of the casing, by the arrangement that the width on the gas-outlet side of the screw rotor is larger than the width on the gas-inlet side of the screw rotor, although the gas pressure in the compression chamber defined by mutual engagement of the screw rotor and the gate rotor becomes higher on the gas outlet side of the screw rotor, yet the outlet side width of the seal surface is so large that the gas within the compression chamber can be prevented from leaking through between the seal surface of the casing and the one surface of the gate rotor.

Also, the inlet side width of the seal surface may be small as it is, so that the area over which the seal surface should have a flatness can be made smaller. Thus, contact of the seal surface of the casing and the one surface of the gate rotor with each other can be prevented.

In accordance with one aspect of the present invention, the seal surface has a first edge on a screw rotor side and a second edge opposed to the first edge, the first edge is formed so as to be parallel to an axis of the screw rotor, the second edge has a first portion and a second portion in this order from gas inlet side toward outlet side of the screw rotor, and the first portion is formed so as to be farther from the first edge on its outlet side, while the second portion is formed so as to be parallel to the first edge.

With such a screw compressor in accordance with of this aspect of the present invention, the first portion is formed so as to be farther from the first edge on the outlet side, while the second portion is formed so as to be parallel to the first edge. Therefore, the outlet side width of the seal surface can be made smaller, so that the area over which the seal surface should have a flatness can be made smaller, thus making it possible to prevent contact of the seal surface of the casing and the one surface of the gate rotor with each other.

Generally, the gas pressure in the compression chamber defined by mutual engagement of the screw rotor and the gate rotor is constant on the gas outlet side of the screw rotor. Therefore, even when the second portion on the outlet side is formed so as to be parallel to the first edge, the gas in the compression chamber can be prevented from leaking through between the seal surface of the casing and the one surface of the gate rotor.

In accordance with one aspect of the present invention, a gas pressure in a compression chamber defined by mutual engagement of the screw rotor and the gate rotor is constant on a gas outlet side of the screw rotor, and the second portion is provided at a position corresponding to a constant-gas-pressure portion in the compression chamber.

With such a screw compressor in accordance with this aspect of the present invention, since the second portion is provided at a position corresponding to a constant-gas-pressure portion in the compression chamber, gas leaks from within the compression chamber can effectively be prevented.

In accordance with one aspect of the present invention, with regard to a gap between the one surface of the gate rotor and the seal surface, a gap on the gas-outlet side of the screw rotor is smaller than a gap on the gas-inlet side of the screw rotor.

With such a screw compressor in accordance with this aspect of the present invention, with regard to the gap between the one surface of the gate rotor and the seal surface, by the arrangement that the gap on the gas-outlet side of the screw rotor is smaller than the gap on the gas-inlet side of the screw rotor, although the gas pressure in the compression chamber defined by mutual engagement of the screw rotor and the gate rotor becomes higher on the gas outlet side of the screw rotor, yet the outlet side gap between the one surface of the gate rotor and the seal surface is so small that the gas within the compression chamber can be prevented from leaking through between the seal surface of the casing and the one surface of the gate rotor.

Also, the inlet side gap between the one surface of the gate rotor and the seal surface may be large as it is, and contact of the seal surface of the casing and the one surface of the gate rotor with each other can be prevented.

In accordance with one aspect of the present invention, the seal surface has a first planar portion and a second planar portion in this order from gas inlet side toward outlet side of the screw rotor, and the first planar portion is formed so as to be increasingly closer to the one surface of the gate rotor on the outlet side, while the second planar portion is formed so as to be parallel to the one surface of the gate rotor.

With such a screw compressor in accordance with of this aspect of the present invention, the first planar portion is formed so as to be increasingly closer to the one surface of the gate rotor on the outlet side, while the second planar portion is formed so as to be parallel to the one surface of the gate rotor. Therefore, the outlet side gap between the one surface of the gate rotor and the seal surface can be made larger, so that contact of the seal surface of the casing and the one surface of the gate rotor with each other can be prevented.

Generally, the gas pressure in the compression chamber defined by mutual engagement of the screw rotor and the gate rotor is constant on the gas outlet side of the screw rotor. Therefore, even when the second planar portion on the outlet side is formed so as to be parallel to the one surface of the gate rotor, the gas in the compression chamber can be prevented from leaking through between the seal surface of the casing and the one surface of the gate rotor.

ADVANTAGEOUS EFFECTS OF INVENTION

With a screw compressor in accordance with one or more of the above aspects of the present invention, with regard to the width of the seal surface of the casing, by the arrangement that the width on the gas-outlet side of the screw rotor is larger than the width on the gas-inlet side of the screw rotor, gas leaks through between the casing and the gate rotor can be prevented while contact of the casing and the gate rotor with each other can be prevented.

DESCRIPTION OF EMBODIMENTS

Hereinbelow, the present invention will be described in detail by way of embodiments thereof illustrated in the accompanying drawings.

(First Embodiment)

Figure 1:
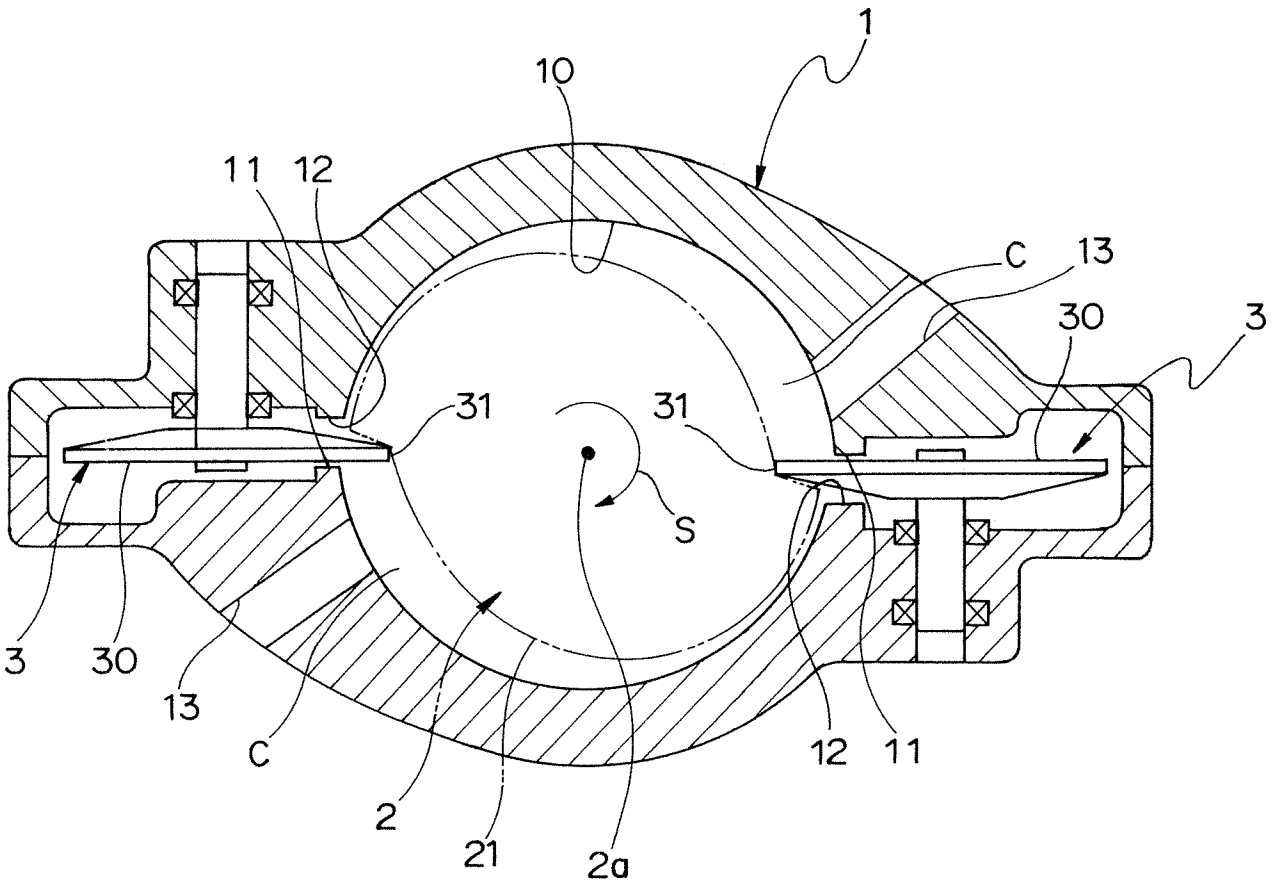
FIG. 1 is a cross-sectional view showing a first embodiment of the screw compressor according to the present invention.

FIG. 1 is a cross-sectional view showing a first embodiment of the screw compressor according to the invention. This screw compressor is a single screw compressor which includes: a casing 1 having a cylinder 10; a cylindrical-shaped screw rotor 2 to be fitted to the cylinder 10; and a gate rotor 3 to be engaged with the screw rotor 2.

The screw rotor 2 has, on its outer peripheral surface, a plurality of spiral groove portions 21. The gate rotor 3, which is disc-shaped, has on its outer peripheral surface a plurality of tooth portions 31 in a gear form. The groove portions 21 of the screw rotor 2 and the tooth portions 31 of the gate rotor 3 are to be engaged with each other.

Mutual engagement of the screw rotor 2 and the gate rotor 3 causes a compression chamber C to be defined. That is, the compression chamber C is a space defined by the groove portions 21 of the screw rotor 2, the tooth portions 31 of the gate rotor 3 and an inner surface of the cylinder 10 of the casing 1.

The gate rotor 3 is placed in one pair on right and left of the screw rotor 2 in point symmetry about an axis 2*a* of the screw rotor 2. The casing 1 is provided with a through hole 12 running through the cylinder 10, and the gate rotor 3 intrudes through this through hole 12 into the cylinder 10.

The screw rotor 2 rotates about the axis 2*a* in an arrow S direction. Along with this rotation of the screw rotor 2, the gate rotor 3 rotates to compress the gas in the compression chamber C. The screw rotor 2 is rotated by a motor (not shown) housed in the casing 1.

That is, a low-pressure gas is sucked into the compression chamber C from one end side of the screw rotor 2 in the axis 2*a* direction. After the low-pressure gas is compressed in the compression chamber C, the compressed high-pressure gas is discharged from an outlet opening 13 provided on the other end side of the screw rotor 2 in the axis 2*a* direction.

Figure 2:
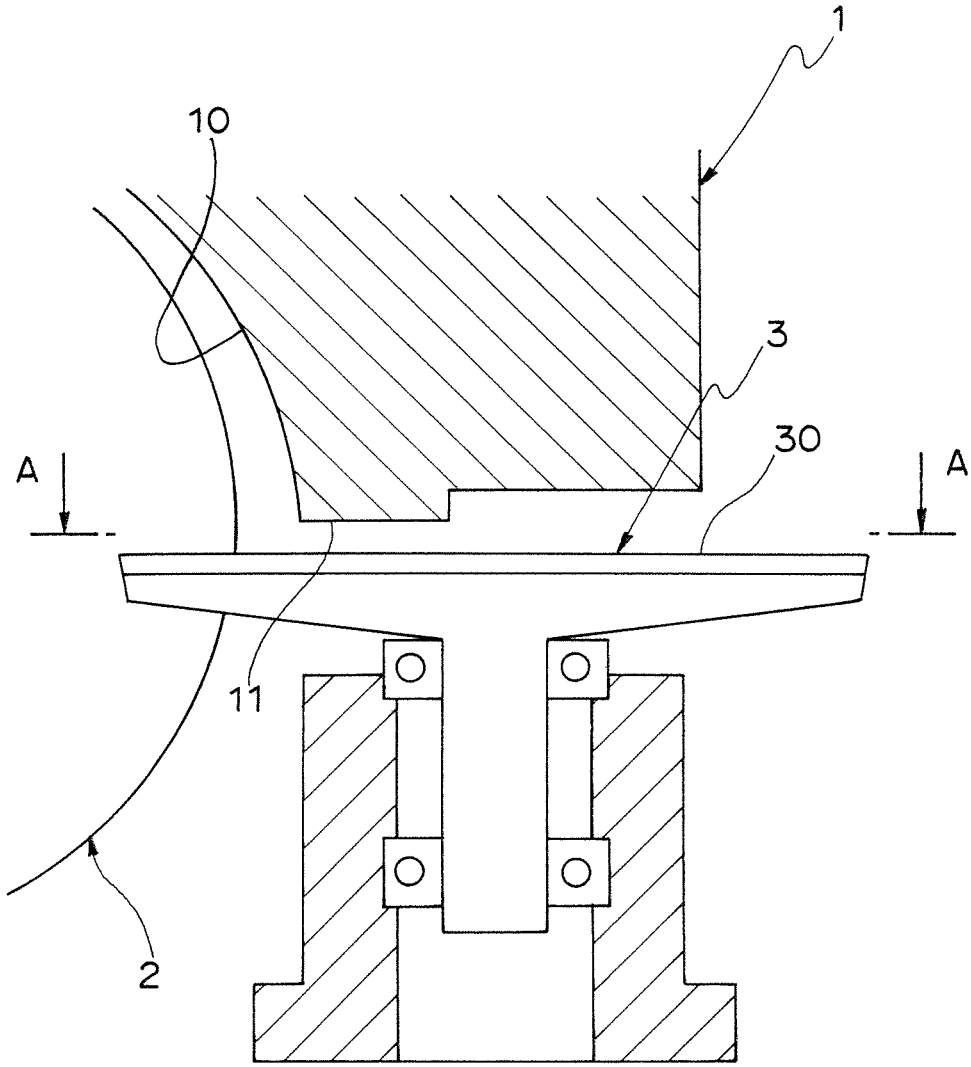
FIG. 2 is an enlarged sectional view of the screw compressor.
Figure 3:
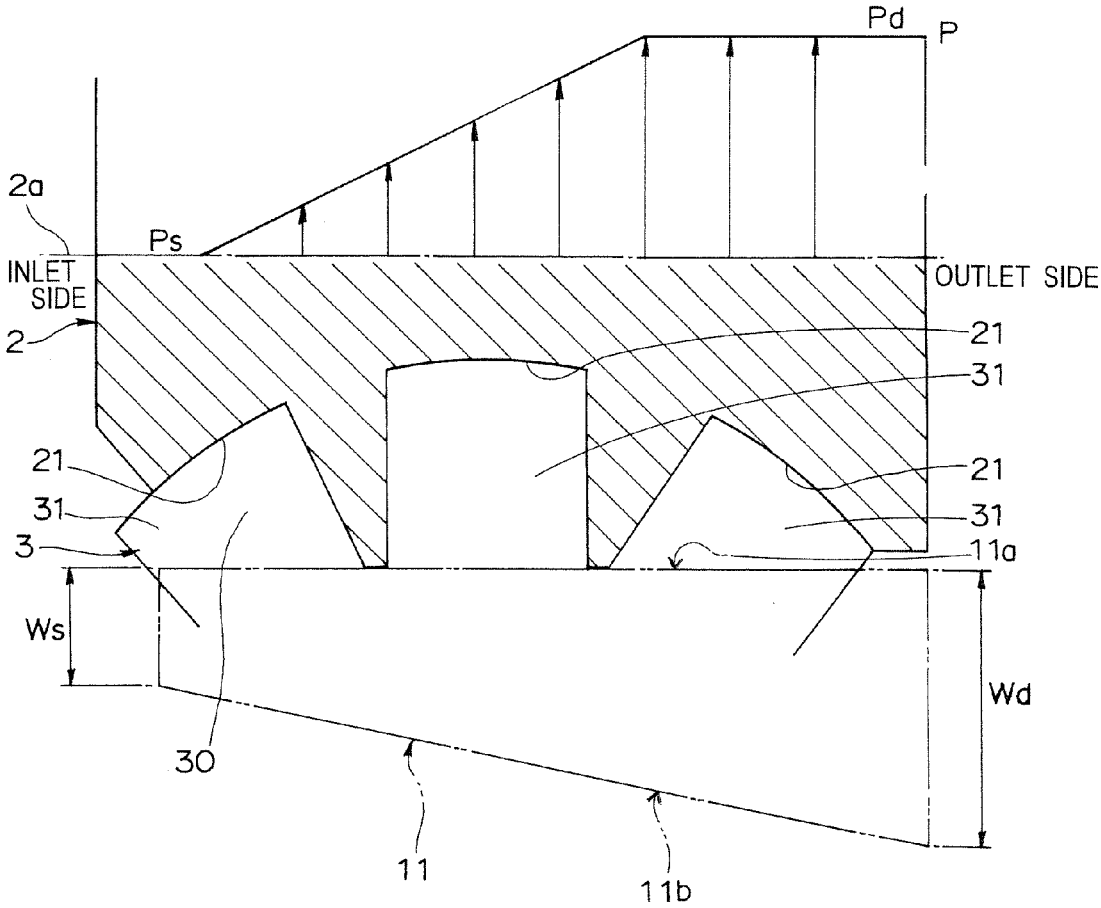
FIG. 3 is a view taken along the line A-A of FIG. 2.

As shown in FIG. 2, which is an enlarged sectional view, and FIG. 3, which is the line A-A view of FIG. 2, a seal surface 11 of the casing 1 is opposed to one surface 30 of the gate rotor 3.

In FIG. 3, the left side of the screw rotor 2 as viewed in the drawing sheet is assumed as an inlet side on which the gas is sucked into the compression chamber C, while the right side of the screw rotor 2 in the drawing sheet is assumed as an outlet side on which the gas is discharged from the compression chamber C.

The seal surface 11 of the casing 1 is a surface which is to be set into adjacent connection with the inner surface of the cylinder 10. The seal surface 11 of the casing 1 extends in a direction parallel to the axis 2*a* of the screw rotor 2.

The one surface 30 of the gate rotor 3 forms part of an inner surface of the compression chamber C. Between the seal surface 11 of the casing 1 and the one surface 30 of the gate rotor 3 is provided a gap of about 60 μm as an example.

With regard to the width of the seal surface 11 of the casing 1, a gas-outlet side width Wd of the screw rotor 2 is larger than a gas-inlet side width Ws of the screw rotor 2.

More specifically, a first edge 11*a* of the seal surface 11 on its screw rotor 2 side is formed in a linear shape so as to be parallel to the axis 2*a* of the screw rotor 2. A second edge 11*b* of the seal surface 11 opposed to the first edge 11*a* is formed in a linear shape with such a skew as to be increasingly farther from the first edge 11*a* on the outlet side. That is, the width of the seal surface 11 increases gradually toward the outlet side.

According to the screw compressor constructed as described above, with regard to the width of the seal surface 11 of the casing 1, by the arrangement that the gas-outlet side width Wd of the screw rotor 2 is larger than the gas-inlet side width Ws of the screw rotor 2, although the gas pressure in the compression chamber C defined by mutual engagement of the screw rotor 2 and the gate rotor 3 becomes higher on the gas outlet side of the screw rotor 2, yet the outlet side width Wd of the seal surface 11 is so large that the gas within the compression chamber C can be prevented from leaking through between the seal surface 11 of the casing 1 and the one surface 30 of the gate rotor 3.

That is, the gas pressure in the compression chamber C is higher on the outlet side of the screw rotor 2 (Ps<Pd in FIG. 3). However, because the outlet side width Wd of the seal surface 11 is larger than the inlet side width Ws of the seal surface 11, the pressure gradient ($dP/dx=(Pd-Pg)/Wd$) between the seal surface 11 and the one surface 30 becomes smaller on the outlet side of the screw rotor 2, so that on the outlet side of the screw rotor 2, the gas in the compression chamber C can be prevented from leaking into the low-pressure space in which the gate rotor 3 is housed. In addition, the pressure Ps refers to a gas pressure on the inlet side in the compression chamber C, the pressure Pd refers to a gas pressure on the outlet side in the compression chamber C, and the pressure Pg refers to a pressure of the low-pressure space in which the gate rotor 3 is housed.

Also according to the screw compressor of the above construction, the inlet side width Ws of the seal surface 11 may be small as it is, so that the area over which the seal surface 11 should have a flatness can be made smaller. Thus, contact of the seal surface 11 of the casing 1 and the one surface 30 of the gate rotor 3 with each other can be prevented.

Figure 4:
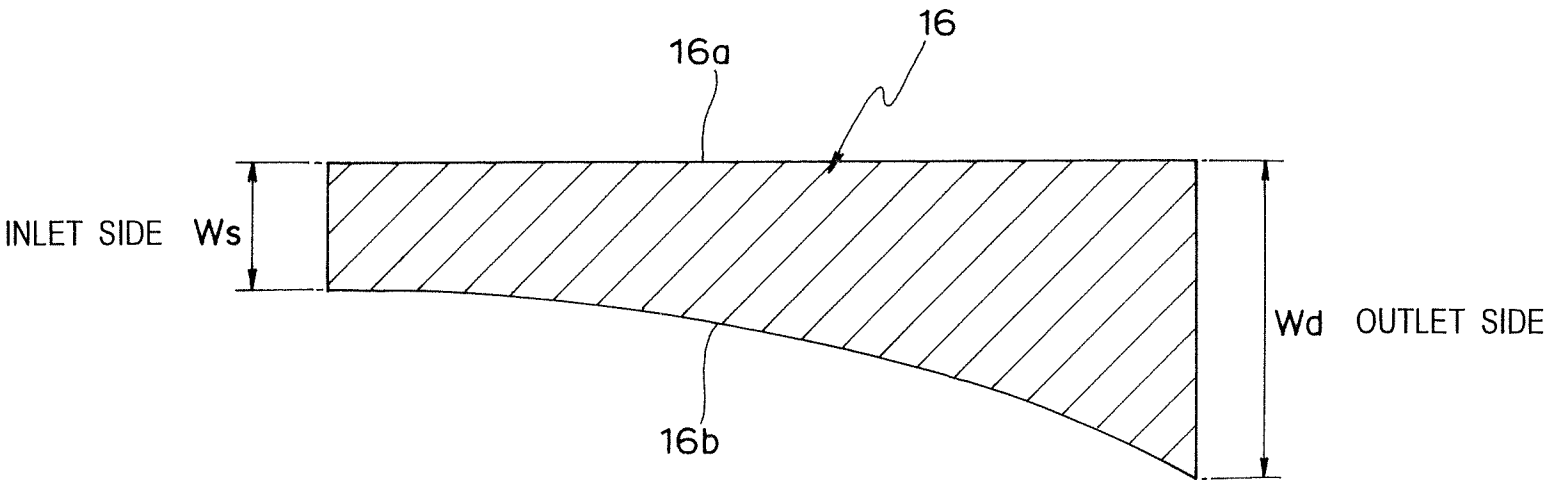
FIG. 4 is a sectional view showing another embodiment of the seal surface.

In addition, it is also allowable that as shown in FIG. 4, a first edge 16*a* of a seal surface 16 on its screw rotor 2 side (as seen in FIG. 3) is formed in a linear shape so as to be parallel to the axis 2*a* of the screw rotor 2 while a second edge 16*b* of the seal surface 16 opposed to the first edge 16*a* is formed in a concavely curved shape so as to be farther from the first edge 16*a* on the outlet side.

(Second Embodiment)

Figure 5:
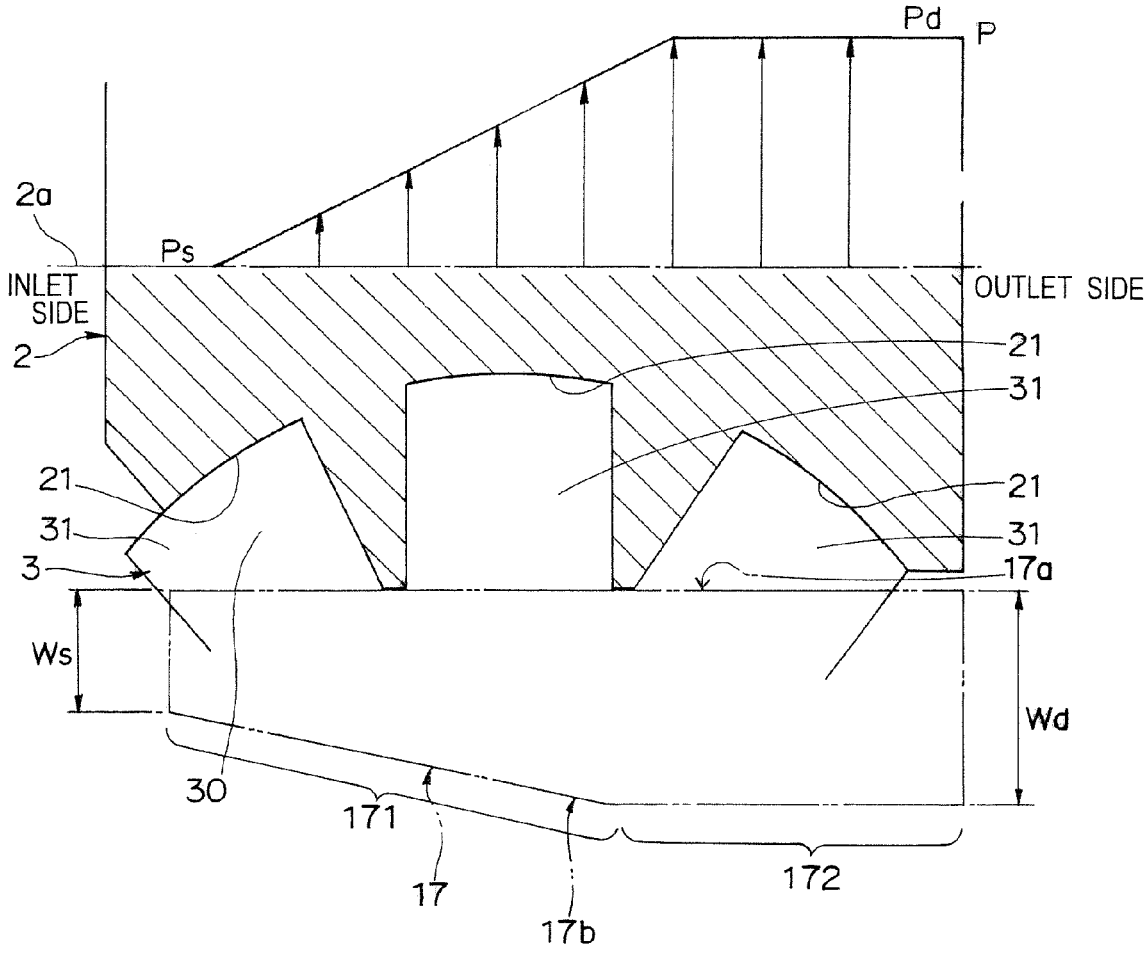
FIG. 5 is a plan view showing a second embodiment of the screw compressor according to the present invention.

FIG. 5 shows a second embodiment of the screw compressor according to the invention. This second embodiment differs from the first embodiment in the shape of the seal surface of the casing. In this second embodiment, like component members in conjunction with the first embodiment are designated by like reference signs and their detailed description is omitted.

As shown in FIG. 5, a seal surface 17 has a first edge 17*a* on the screw rotor 2 side and a second edge 17*b* opposed to the first edge 17*a*.

The first edge 17*a* is formed in a linear shape so as to be parallel to the axis 2*a* of the screw rotor 2.

The second edge 17*b* has a first portion 171 and a second portion 172 in this order from gas inlet side toward outlet side of the screw rotor 2.

The first portion 171 is formed in a linear shape so as to be farther from the first edge 17*a* on the outlet side. In addition, the first portion 171 may be formed in a curved shape.

The second portion 172 is formed in a linear shape so as to be parallel to the first edge 17*a*.

More specifically, a gas pressure in the compression chamber C defined by mutual engagement of the screw rotor 2 and the gate rotor 3 is constant on the gas outlet side of the screw rotor 2. The second portion 172 is provided at a position corresponding to a constant-gas-pressure portion in the compression chamber C.

According to the screw compressor constructed as described above, the first portion 171 is formed so as to be farther from the first edge 17*a* on the outlet side, while the second portion 172 is formed so as to be parallel to the first edge 17*a*. Therefore, the outlet side width of the seal surface 17 can be made smaller, so that the area over which the seal surface 17 should have a flatness can be made smaller, thus making it possible to prevent contact of the seal surface 17 of the casing 1 and the one surface 30 of the gate rotor 3 with each other.

Generally, the gas pressure in the compression chamber C defined by mutual engagement of the screw rotor 2 and the gate rotor 3 is constant on the gas outlet side of the screw rotor 2. Therefore, even when the second portion 172 on the outlet side is formed so as to be parallel to the first edge 17*a*, the gas in the compression chamber C can be prevented from leaking through between the seal surface 17 of the casing 1 and the one surface 30 of the gate rotor 3.

Further, since the second portion 172 is provided at a position corresponding to a constant-gas-pressure portion in the compression chamber C, leaks of the gas in the compression chamber C can effectively be prevented.

(Third Embodiment)

Figure 6:
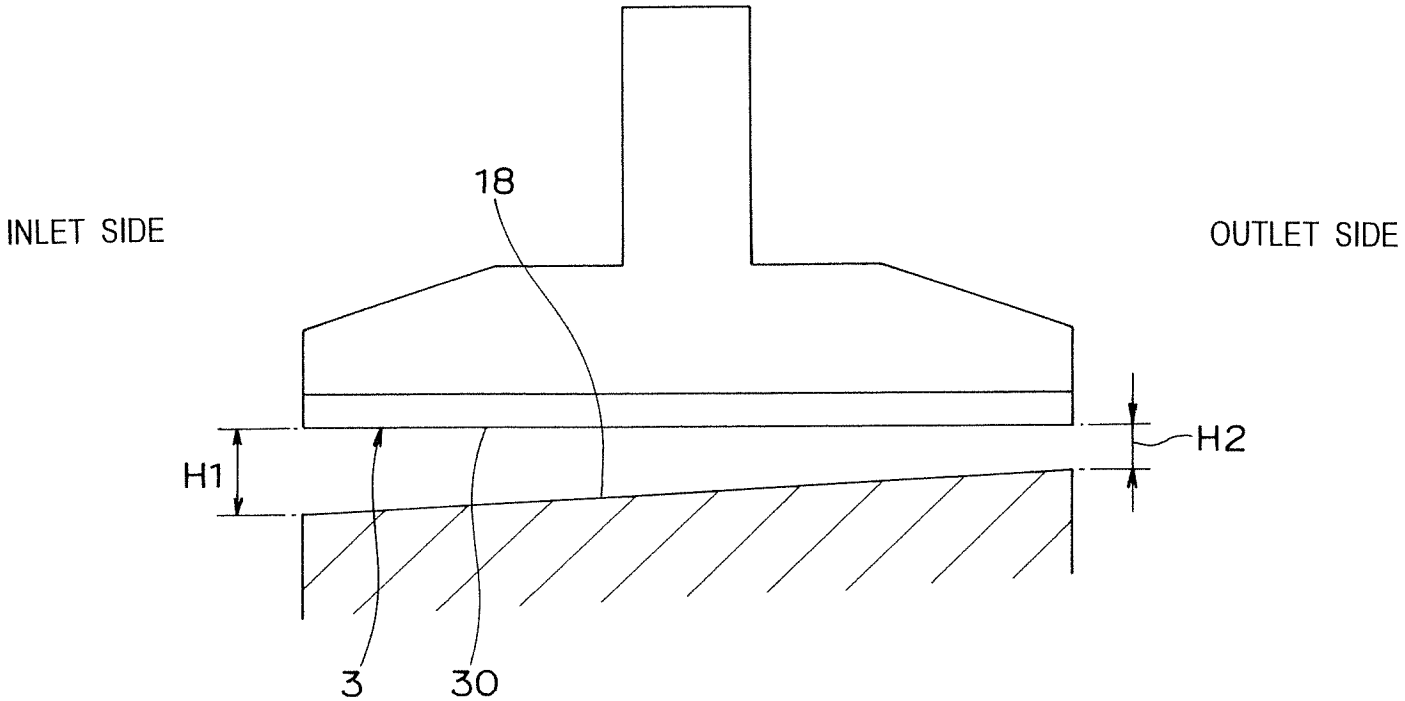
FIG. 6 is a side view showing a third embodiment of the screw compressor according to the present invention.

FIG. 6 shows a third embodiment of the screw compressor according to the invention. This third embodiment differs from the first embodiment in the shape of the seal surface of the casing. In this third embodiment, like component members in conjunction with the first embodiment are designated by like reference signs and their detailed description is omitted.

As shown in FIG. 6, with regard to the gap between the one surface 30 of the gate rotor 3 and a seal surface 18, a gap H2 on the gas-outlet side of the screw rotor 2 is smaller than a gap H1 on the gas-inlet side of the screw rotor.

The seal surface 18 is formed so as to be increasingly closer to the one surface 30 of the gate rotor 3 on the outlet side.

According to the screw compressor constructed as described above, with regard to the gap between the one surface 30 of the gate rotor 3 and the seal surface 18, since the gas-outlet side gap H2 of the screw rotor 2 is smaller than the gas-inlet side gap H1 of the screw rotor 2, the gas pressure in the compression chamber C defined by mutual engagement of the screw rotor 2 and the gate rotor 3 becomes higher on the gas outlet side of the screw rotor 2. However, the gap between the one surface 30 of the gate rotor 3 and the seal surface 18 is so small that the gas in the compression chamber C can be prevented from leaking through between the seal surface 18 of the casing 1 and the one surface 30 of the gate rotor 3.

Further, the inlet side gap between the one surface 30 of the gate rotor 3 and the seal surface 18 may be large as it is, under which condition contact between the seal surface 18 of the casing 1 and the one surface 30 of the gate rotor 3 can be prevented.

(Fourth Embodiment)

Figure 7:
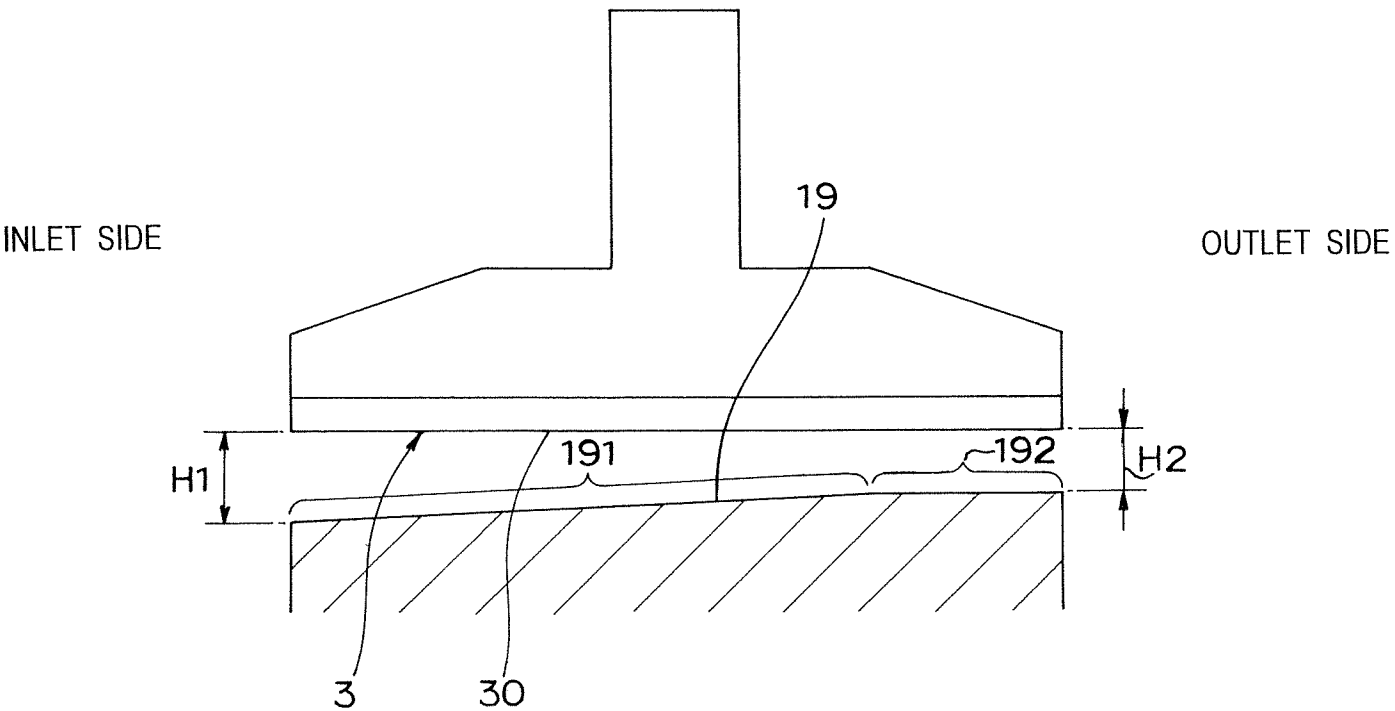
FIG. 7 is a side view showing a fourth embodiment of the screw compressor according to the present invention.
Figure 8:
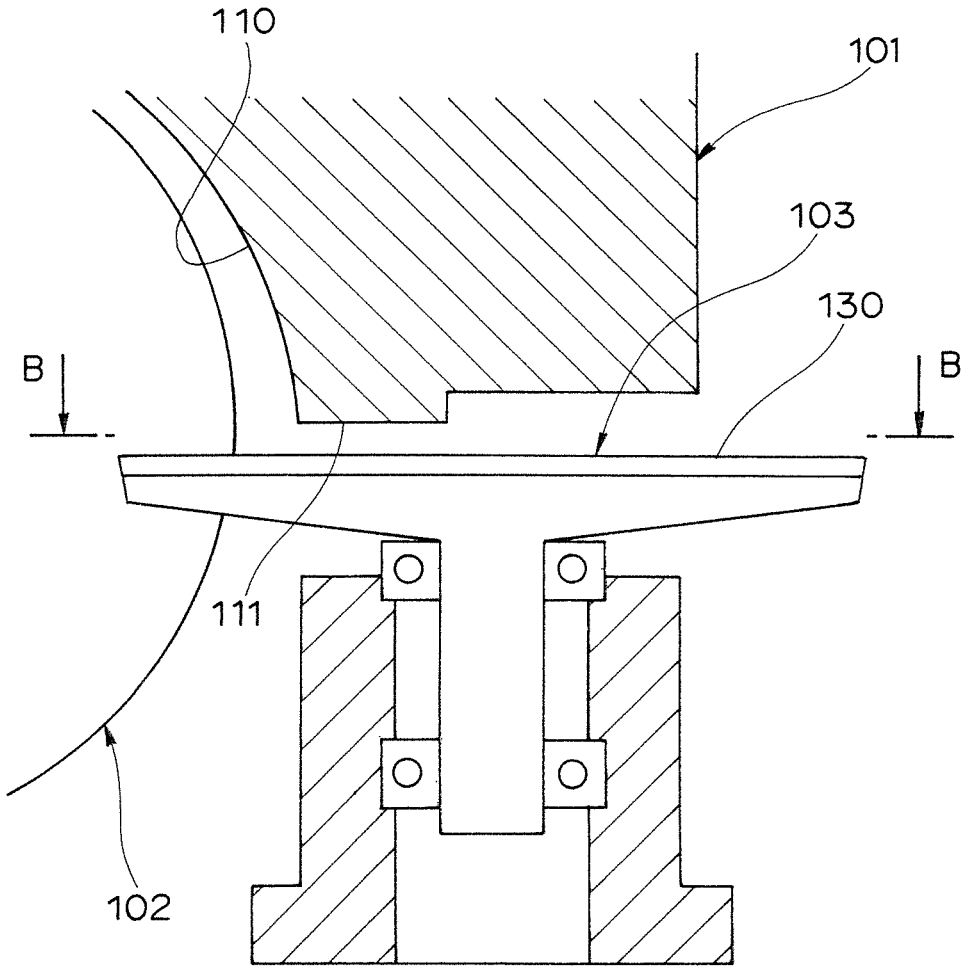
Fig.8 PRIOR ART
FIG. 8 is an enlarged sectional view of a conventional screw compressor.
Figure 9:
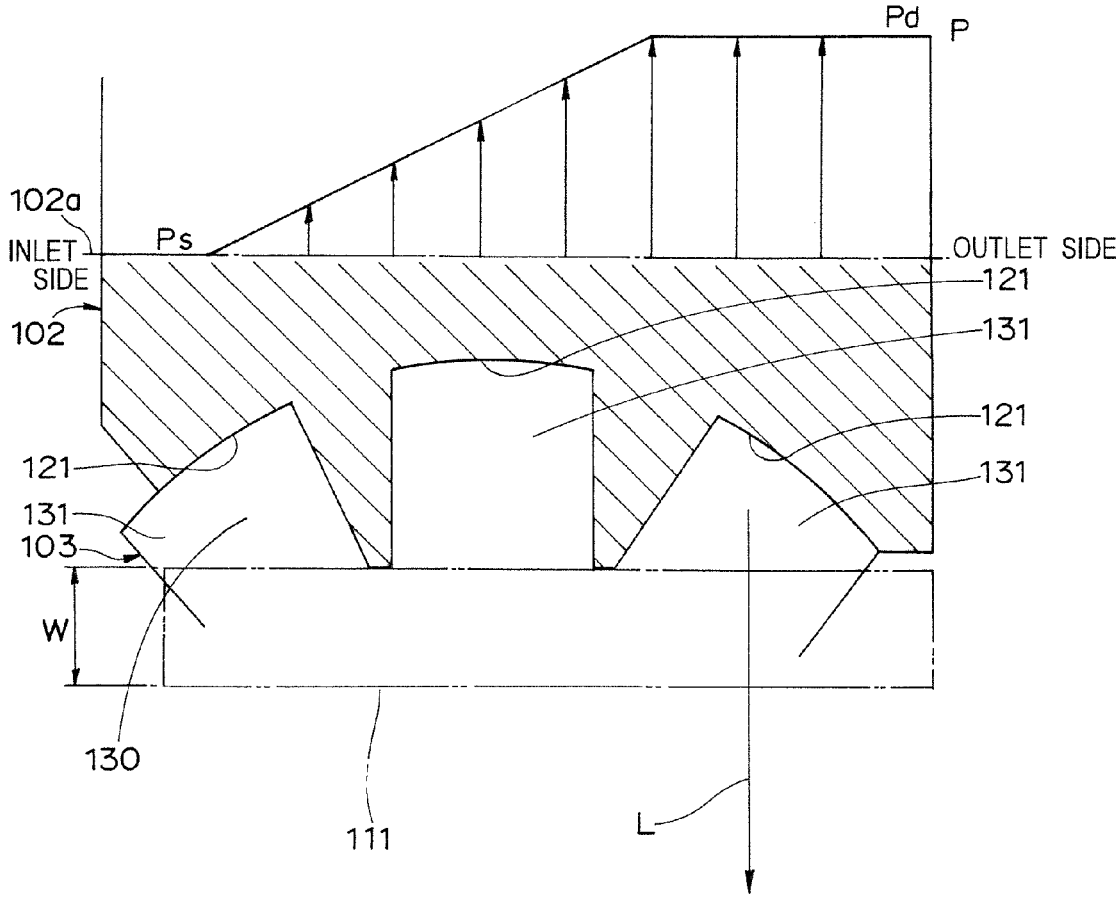
Fig.9 PRIOR ART
FIG. 9 is a view taken along the line B-B of FIG. 8.

FIG. 7 shows a fourth embodiment of the screw compressor according to the invention. This fourth embodiment differs from the first embodiment in the shape of the seal surface of the casing. In this fourth embodiment, like component members in conjunction with the third embodiment are designated by like reference signs and their detailed description is omitted.

As shown in FIG. 7, a seal surface 19 has a first planar portion 191 and a second planar portion 192 in this order from gas inlet side toward outlet side of the screw rotor 2.

The first planar portion 191 is formed so as to be increasingly closer to the one surface 30 of the gate rotor 3 on the outlet side.

The second planar portion 192 is formed so as to be parallel to the one surface 30 of the gate rotor 3.

In addition, the gas pressure in the compression chamber C defined by mutual engagement of the screw rotor 2 and the gate rotor 3 is constant on the gas outlet side of the screw rotor 2. Therefore, the second planar portion 192 may be provided at a position corresponding to a constant-gas-pressure portion in the compression chamber C.

According to the screw compressor constructed as described above, the first planar portion 191 is formed so as to be increasingly closer to the one surface 30 of the gate rotor 3 on the outlet side, while the second planar portion 192 is formed so as to be parallel to the one surface 30 of the gate rotor 3. Therefore, the outlet side gap between the one surface 30 of the gate rotor 3 and the seal surface 19 can be made larger, so that contact between the seal surface 19 of the casing 1 and the one surface 30 of the gate rotor 3 can be prevented.

Generally, the gas pressure in the compression chamber C defined by mutual engagement of the screw rotor 2 and the gate rotor 3 is constant on the gas outlet side of the screw rotor 2. Therefore, even when the second planar portion 192 on the outlet side is formed so as to be parallel to the one surface 30 of the gate rotor 3, the gas in the compression chamber C can be prevented from leaking through between the seal surface 19 of the casing 1 and the one surface 30 of the gate rotor 3.

It is noted that the present invention is not limited to the above-described embodiments. For example, the width of the seal surface of the casing may also be formed so as to increase stepwise toward the outlet side, and the seal surface may be formed into any shape only if the outlet side width of the seal surface is larger than the inlet side width of the seal surface.

Furthermore, the gap between the one surface of the gate rotor and the seal surface may be formed so as to decrease stepwise toward the outlet side, and the seal surface may be formed into any shape only if the outlet side gap is smaller than the inlet side gap.

What is claimed is:

1. A screw compressor comprising:

a casing having a cylinder;

a cylindrical-shaped screw rotor configured to be fitted into the cylinder; and a gate rotor configured to be engaged with the screw rotor, with an outlet width of a seal surface of the casing on a gas-outlet side of the screw rotor being larger than an inlet width of the seal surface on a gas-inlet side of the screw rotor, the seal surface of the casing being opposed to one surface of the gate rotor, the seal surface having a first edge on a screw rotor side and a second edge opposed to the first edge, the first edge being formed so as to be parallel to an axis of the screw rotor, the second having a first portion and a second portion arranged in order from the gas inlet side toward the gas outlet side of the screw rotor, and the first portion being formed so as to be farther from the first edge on an outlet side thereof, and the second portion being formed on as to be parallel to the first edge.

2. The screw compressor as claimed in claim 1, wherein a gas pressure in a compression chamber defined by mutual engagement of the screw rotor and the gate rotor is constant on the gas outlet side of the screw rotor, and the second portion of the second edge is provided at a position corresponding to a constant-gas-pressure portion in the compression chamber.

3. The screw compressor as claimed in claim 2, wherein a gap is formed between the one surface of the gate rotor and the seal surface, and the gap on the gas-outlet side of the screw rotor is smaller than the gap on the gas-inlet side of the screw rotor.

4. The screw compressor as claimed in claim 3, wherein the seal surface has a first planar portion and a second planar portion arranged in order from the gas inlet side toward the gas outlet side of the screw rotor, and the first planar portion is formed so as to be increasingly closer to the one surface of the gate rotor on the outlet side of the screw rotor, while the second planar portion is formed so as to be parallel to the one surface of the gate rotor.

5. The screw compressor as claimed in claims 1, wherein a gap is formed between the one surface of the gate rotor and the seal surface, and the gap on the gas-outlet side of the screw rotor is smaller than the gap on the gas-inlet side of the screw rotor.

6. The screw compressor as claimed in claim 5, wherein the seal surface has a first planar portion and a second planar portion arranged in order from the gas inlet side toward the gas outlet side of the screw rotor, and the first planar portion is formed so as to be increasingly closer to the one surface of the gate rotor on the outlet side of the screw rotor, while the second planar portion is formed so as to be parallel to the one surface of the gate rotor.

7. A screw compressor comprising:

a casing having a cylinder;

a cylindrical-shaped screw rotor configured to be fitted into the cylinder; and a gate rotor configured to be engaged with the screw rotor, with an outlet width of a seal surface of the casing on a gas-outlet side of the screw rotor being larger than an inlet width of the seal surface on a gas-inlet side of the screw rotor, the seal surface of the casing being opposed to one surface of the gate rotor, a gap being formed between the one surface of the gate rotor and the seal surface, and the gap on the gas-outlet side of the screw rotor being smaller than the gap on the gas-inlet side of the screw rotor.

8. The screw compressor as claimed in claim 7, wherein the seal surface has a first planar portion and a second planar portion arranged in order from the gas inlet side toward the gas outlet side of the screw rotor, and the first planar portion is formed so as to be increasingly closer to the one surface of the gate rotor on the outlet side of the screw rotor, while the second planar portion is formed so as to be parallel to the one surface of the gate rotor.

9. A screw compressor comprising:

a casing having a cylinder;

a cylindrical-shaped screw rotor configured to be fitted into the cylinder; and a gate rotor configured to be engaged with the screw rotor, with an outlet width of a seal surface of the casing on a gas-outlet side of the screw rotor being larger than an inlet width of the seal surface on a gas-inlet side of the screw rotor, the seal surface of the casing being opposed to one surface of the gate rotor, the seal surface extending along the rotation axis direction of the screw rotor, and the seal surface extending outwardly from an edge of the cylinder, the one surface of the gate rotor forming part of the inner surface of the compression chamber and being perpendicularly arranged relative to a rotation axis of the gate rotor, and the one surface and the seal surface being opposed to each other to face each other, and the inlet width of the seal surface and the outlet width of the seal surface being measured in a direction transverse to the edge of the cylinder.

* * * * *